US008105219B1

(12) United States Patent
Sloan et al.

(10) Patent No.: US 8,105,219 B1
(45) Date of Patent: Jan. 31, 2012

(54) CHEERLEADER TRAINING DEVICE

(76) Inventors: Paula E. Sloan, Vian, OK (US); Jody A. Sloan, Vian, OK (US)

( * ) Notice: Subject to any disclaimer, the term of this patent is extended or adjusted under 35 U.S.C. 154(b) by 52 days.

(21) Appl. No.: 12/419,136

(22) Filed: Apr. 6, 2009

(51) Int. Cl.
*A63B 22/14* (2006.01)

(52) U.S. Cl. ..... 482/146; 482/30; 482/79; 482/130

(58) Field of Classification Search ..... 482/15, 482/17, 23, 27, 28, 29, 30, 31, 32, 79, 111, 482/112, 113, 122, 123, 124, 129, 130, 146, 482/33, 77; 297/313, 314; 472/103–105
See application file for complete search history.

(56) References Cited

U.S. PATENT DOCUMENTS

| | | | | | |
|---|---|---|---|---|---|
| 650,310 | A | * | 5/1900 | Dunning | 182/137 |
| 952,871 | A | * | 3/1910 | Browder | 182/139 |
| 1,509,750 | A | * | 9/1924 | Campbell | 482/26 |
| 2,494,094 | A | * | 1/1950 | Horstman | 482/128 |
| 3,078,479 | A | * | 2/1963 | Grosse et al. | 5/104 |
| D198,923 | S | * | 8/1964 | Mitchell | D21/688 |
| D199,984 | S | * | 1/1965 | Mitchell et al. | D21/688 |
| 3,276,764 | A | * | 10/1966 | Bitterberg | 267/4 |
| 3,365,194 | A | * | 1/1968 | Strickland, Jr. | 482/33 |
| 3,475,019 | A | * | 10/1969 | Mutter et al. | 472/135 |
| 3,635,471 | A | * | 1/1972 | Caron | 482/4 |
| 3,659,844 | A | * | 5/1972 | Cummins | 482/130 |
| 3,929,329 | A | * | 12/1975 | Rivera | 482/71 |
| 4,351,521 | A | * | 9/1982 | Erdos | 472/104 |
| 4,379,550 | A | * | 4/1983 | Petersen | 472/104 |
| 4,386,772 | A | * | 6/1983 | Wu | 482/28 |
| 4,509,743 | A | | 4/1985 | Lie | |
| 4,728,087 | A | * | 3/1988 | Wils | 267/178 |
| 5,062,629 | A | * | 11/1991 | Vaughan | 482/51 |
| 5,087,037 | A | * | 2/1992 | Morrow | 482/33 |
| 5,509,871 | A | * | 4/1996 | Giovanni | 482/51 |
| 5,522,772 | A | * | 6/1996 | Chenard et al. | 472/103 |
| 5,613,690 | A | | 3/1997 | McShane et al. | |
| 5,688,210 | A | * | 11/1997 | Chou | 482/56 |
| 5,713,819 | A | * | 2/1998 | Hsieh | 482/77 |
| 5,980,432 | A | * | 11/1999 | Ahman | 482/77 |
| 6,334,624 | B1 | * | 1/2002 | Giglio | 280/304.1 |
| 6,419,586 | B1 | | 7/2002 | Chiu | |
| 6,461,285 | B1 | | 10/2002 | Theunissen et al. | |
| 6,598,365 | B2 | * | 7/2003 | Abraham et al. | 52/403.1 |
| 6,652,432 | B2 | * | 11/2003 | Smith | 482/146 |

(Continued)

OTHER PUBLICATIONS

Website: http://shop.championsportstraining.com.

(Continued)

*Primary Examiner* — Loan Thanh
*Assistant Examiner* — Daniel Roland
(74) *Attorney, Agent, or Firm* — Gable Gotwals

(57) ABSTRACT

A training apparatus for use by flyers in a cheerleading squad includes a stable base assembly, a balancing assembly, and a fixed or adjustable column located between the stable base assembly and the balancing assembly. The balancing assembly includes a deflectably resilient member and a standing surface that promotes proper alignment and mimics the feel that a flyer experiences when being supported by a base cheerleader. The deflectably resilient member provides two degrees of freedom of movement to the standing surface when the standing surface is under an external load. The standing surface preferably provides about the same standing area that typically provided by a base cheerleader. The column may be a fluid-activated cylinder that moves between a first and second vertical position and simulates a flyer being raised by the base.

12 Claims, 3 Drawing Sheets

U.S. PATENT DOCUMENTS

| | | | | |
|---|---|---|---|---|
| 6,676,579 | B1 * | 1/2004 | Lin | 482/146 |
| 6,692,419 | B2 * | 2/2004 | Chen | 482/146 |
| 6,761,666 | B2 * | 7/2004 | Chou | 482/52 |
| 6,790,166 | B2 | 9/2004 | Broudy | |
| 6,916,276 | B1 | 7/2005 | Robinson | |
| 6,976,939 | B2 * | 12/2005 | Harker et al. | 482/52 |
| 7,070,415 | B2 | 7/2006 | Hojo et al. | |
| 7,081,075 | B2 * | 7/2006 | Sachs | 482/147 |
| 7,086,996 | B2 | 8/2006 | Matjacic et al. | |
| 7,300,392 | B1 | 11/2007 | Curran | |
| 7,476,188 | B2 * | 1/2009 | Perez, Jr. | 482/142 |
| 7,614,990 | B2 * | 11/2009 | Baek | 482/146 |
| 7,645,221 | B1 * | 1/2010 | Curry | 482/148 |
| 2007/0117697 | A1 * | 5/2007 | Genua | 482/146 |
| 2007/0184940 | A1 * | 8/2007 | Tomes | 482/92 |
| 2008/0280741 | A1 * | 11/2008 | Baek | 482/146 |
| 2009/0197744 | A1 * | 8/2009 | Yamazaki | 482/57 |
| 2009/0227426 | A1 * | 9/2009 | Dubar | 482/34 |
| 2009/0230743 | A1 * | 9/2009 | Derakhshan et al. | 297/329 |

OTHER PUBLICATIONS

Website: http://cheerleading.about.com/od/fitnesshealthandbeauty/gr/mae_flyer.htm.

Website: http://www.gymsupply.com/index.asp?PageAction=VIEWCATS&Category=236.

* cited by examiner

CHEERLEADER TRAINING DEVICE

BACKGROUND OF THE INVENTION

The present invention relates to an apparatus for the balance training of athletes and, more particularly, for the balance training of "cheer flyers" in the field of cheerleading.

Cheerleading is an increasingly popular sport that has evolved over time to demand the strength, balance and body coordination more commonly associated with sports like gymnastics. The rise of gymnastic-like movements in cheerleading, however, has also correlated with a dramatic increase in the number of cheerleading-related injuries. For example, the Center for Injury Research and Policy at the Columbus Children's Research Institute (Children's Hospital, Columbus, Ohio) reported in a study published in 2006 that the number of cheerleading-related injuries more than doubled during the 13-year study period. The study's authors called for improved safety of the sport through the implementation of rules and regulations and safety certification for coaches.

Improved training devices and methods that teach proper technique can also work to prevent injury. One of the more injury-prone positions in cheerleading is the "cheer flyer" or flyer. A flyer is the person at the top of the cheerleading formation that is supported by the "cheer bases" and then lifted or thrown in the air. While the flyer requires a number of skills—including a respect for heights, core body strength, and ankle, knee and hip strength—one key skill is balance. Balance is important because it is much more difficult for the bases to hold up the flyer if the flyer is wiggling around or shifting his or her weight. In addition, the flyer often has to support his- or herself on one leg while being lifted in the air and then perform a jump or tumbling maneuver from this position.

Various training devices have been developed and sold commercially to assist a flyer in improving his or her balance. These devices, which also attempt to improve the flyer's strength, include balls and boards, discs and air-filled discs having arc-shaped bottom surfaces. Many of these devices attempt to mimic the feel of the flyer being supported by the base. The devices, however, fail to accomplish this feel for a variety of reasons. Some of the devices provide too large of an area for the foot or require that both feet be used, as is the case with U.S. Pat. No. 4,509,743, issued to Lie on Apr. 9, 1985 ("the Lie patent"). Other devices fail to provide sufficient height above the floor. Still others provide a balancing element that does not behave in a manner similar to that of a base when supporting a flyer or fail to provide a mounting experience analogous to that encountered by a flyer (see, for example, the Lie patent). More importantly, these devices fail to require the proper body alignment as that needed while in the air and supported by a base. The devices also fail to allow for training of more advanced body positions such as the "Liberty," in which the flyer's leg is bent with one or two arms in a V-position, the "Heel Stretch," in which the bent leg is held straight up with the flyer's hand, and the "Bow and Arrow," in which the flyer's other arm crosses the leg being held straight up.

BRIEF SUMMARY OF THE INVENTION

A training apparatus according to this invention includes a column supporting a balancing assembly which includes a deflectably resilient member and a standing surface. The deflectably resilient member, which mimics the feel of a flyer cheerleader when supported by a base cheerleader, preferably provides no more than two degrees of freedom of movement to the standing surface when the standing surface is under an external load. In a preferred embodiment, the deflectably resilient member is in the form of at least one compression spring. In another preferred embodiment, the deflectably resilient member is in the form of at least one compressible member.

The column provides sufficient height for the standing surface above the floor and may be a fixed column or an adjustable column. In a preferred embodiment, the column places the standing surface about 15 inches above the floor. In another preferred embodiment, the column is a fluid-activated cylinder, such as a pneumatic or hydraulic cylinder, which is capable of moving between a first vertical position and a second vertical position, thereby mimicking the feel a flyer experiences when being raised by the bases.

The standing surface is preferably a narrow, rectangular-shaped, substantially horizontal surface that provides about the same surface area as that normally encountered by a flyer when being supported by a base cheerleader's hand, shoulder or thigh. In a preferred embodiment, the width of the standing surface is about 4 inches and its length is about 6 inches. In another preferred embodiment, the standing surface is an adjustable width or length standing surface.

A better understanding of the invention will be obtained from the following detailed description of the preferred embodiments taken in conjunction with the drawings and the attached claims.

DETAILED DESCRIPTION OF THE PREFERRED EMBODIMENTS

Figure 6:
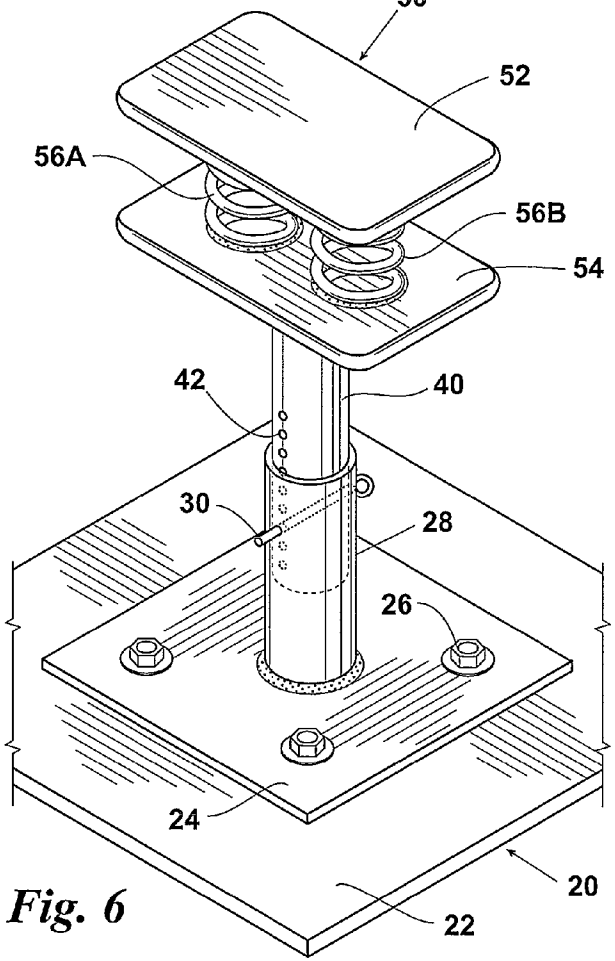
FIG. 6 is an isometric view of an adjustable height column. Younger cheerleaders or beginning cheerleaders may prefer to start training at a lower height and then increase the height as skill increases and more confidence is obtained. The receiver and pin combination also allow for a column of one height to be quickly changed with a column of a different height.

Preferred embodiments of a cheerleader training device will now be described by making reference to the drawings and the following elements illustrated in the drawings:

| | |
|---|---|
| 10 | Training device |
| 20 | Base assembly |
| 22 | Base |
| 24 | Base plate |
| 26 | Bolts |
| 28 | Receiver |
| 30 | Pin |
| 40 | Support column |
| 42 | Adjustment hole |
| 50 | Balancing assembly |
| 52 | Standing surface |
| 54 | Support plate |
| 56 | Deflectably resilient member |

Figure 1:
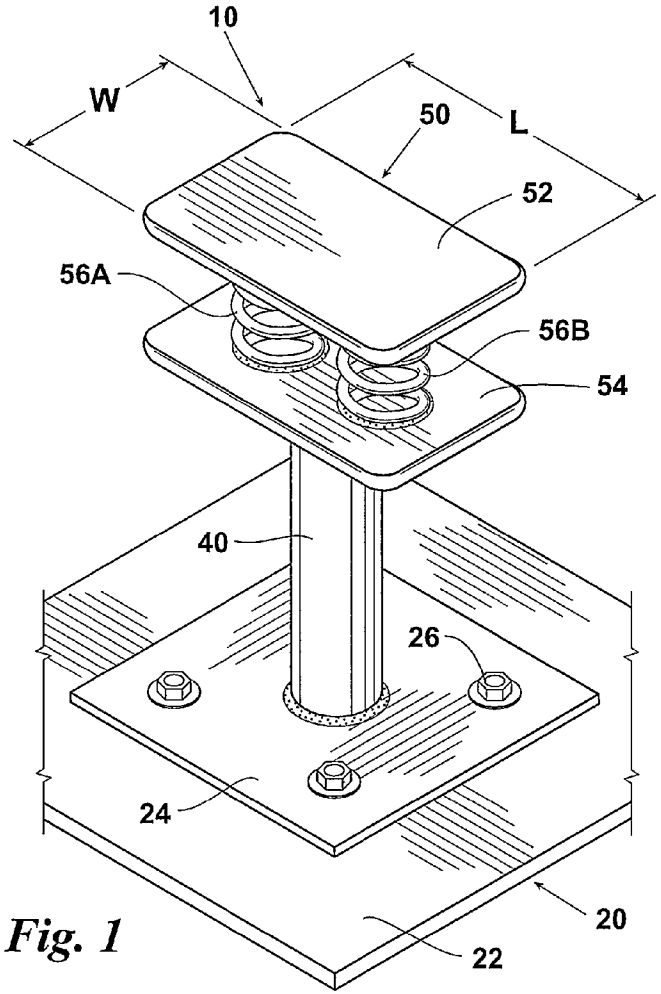
FIG. 1 is an isometric view of the training device. The device includes a base portion, a column, and a balancing assembly supported by the column. The column provides sufficient training height above the floor. The balancing assembly includes a deflectably resilient member, shown here as a pair of spaced-apart springs, located beneath the standing surface and above a member support surface. The device mimics the feel that a flyer experiences when being supported by a base cheerleader.
Figure 2:
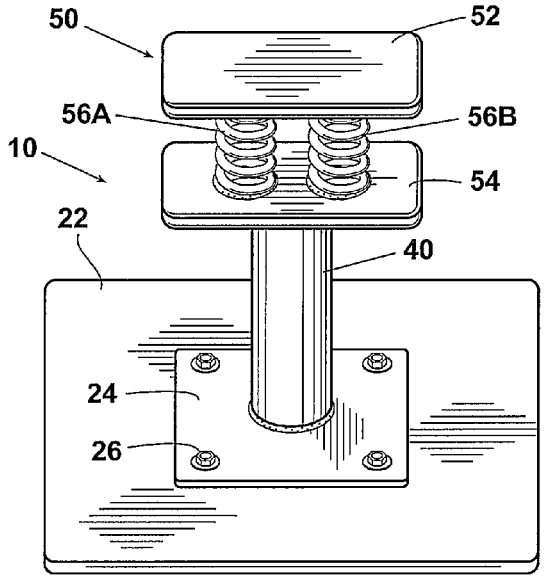
FIG. 2 is a side isometric view of an alternate embodiment of the training device. The base portion has sufficient mass and area to stabilize the apparatus when in use.

Referring to the drawings and first to FIGS. 1, 2 & 6, the training device 10 includes a stable base assembly 20, a support column 40, and a balancing assembly 50. Base assembly 20 must be of sufficient size and mass to provide stability for device 10 so that device 10 does not tip over when in use. In a preferred embodiment, base assembly 20 is a metal base plate 24 that is secured by bolts 26 to a larger sized wooden base 22.

The lower end of column 40 is preferably permanently secured to base plate 24. In another preferred embodiment, column 40 may include a series of adjustment holes 42 for adjusting the height of column 40 to a height appropriate for the age and skill level of the user. Column 40 is tightly received by a receiver 28 and detachably secured to the receiver 28 by way of a pin 30. A sufficient length of column 40, however, must remain in receiver 28 to prevent any side-to-side movement of column 40. Alternatively, the upper end of column 40 may be permanently secured to the lower surface of support plate 54 or tightly received by a similarly configured receiver 28 (not shown). By detachably securing column 40 to base plate 24 or support plate 54, different fixed-length column 40*s* may be employed. In a preferred embodiment, a permanently secured column 40 places the standing surface 52 at a height of about 15" for use with users ranging in age from 10 to 18 years old.

Device 10 may be—with the exception of base 22 and bolts 26—an all metal, all welded construction. Although the type of material used in device 10 is not the inventive feature, lighter materials, such as plastic, may be used for various components of device 10 provided that proper structural support and weighting are added. For example, base 22 may be a sand- or fluid-filled rectangular plastic compartment having appropriate internal structural support. A thick-walled plastic column 40 may be directly received by base 22 and filled with sand or fluid in its lower half, or column 40 may detachably or permanently connect to base 22 way of a plate 24. Balancing assembly 50 may also include a plastic standing surface 52 and support plate 54.

Figure 4:
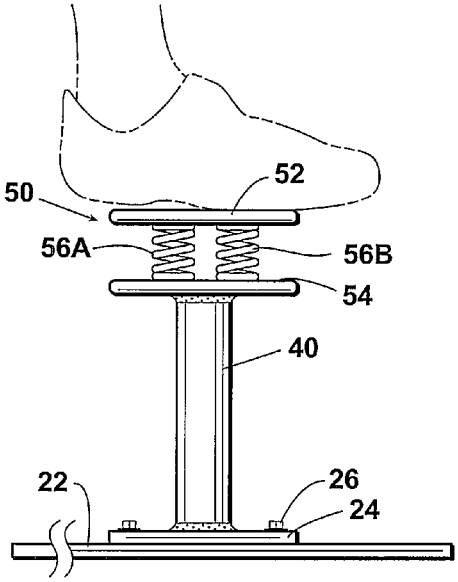
FIG. 4 is a side view of the training device as the user balances on the training device. The deflectably resilient member partially compresses yet retains dynamic instability. The sizing of the standing surface and its arrangement relative to the column helps ensure that the user is always in the proper alignment when correctly performing any flyer position. This alignment is the same as that required by the flyer when being supported by a base cheerleader.
Figure 3:
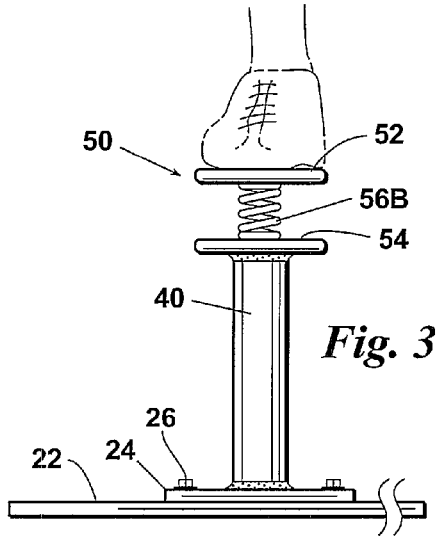
FIG. 3 is a front view of the training device as a user mounts the device and attempts a basic, intermediate or advanced flyer position. The standing surface provides about the same surface area that a flyer would have when being supported by a base cheerleader.
Figure 5:
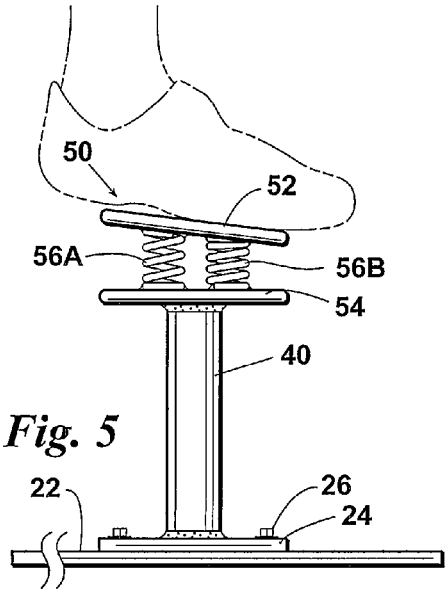
FIG. 5 is a side view of the training device as the user starts to lose balance and roll to the side of the standing surface. The deflectably resilient member responds accordingly, further compressing to the side or end toward which the user has shifted his or her weight and decompressing along the opposite side.

Balancing assembly 50, in combination with base assembly 20 and column 40, promotes proper technique for a flyer. This feature of device 10 is important because without proper technique, the flyer will not be able to balance and remain on device 10 nor maintain balance when being supported by the base. See e.g., FIGS. 3 to 5. Balancing assembly 50, which is preferably centered relative to column 40 and base assembly 20, includes a standing surface 52, a support plate 54, and a deflectably resilient member 56 disposed between the standing surface 52 and the support member 54.

Balancing assembly 50 prevents the user from lifting her heel or toe from support member 54. If the user does either of these, she will have to check her balance or come off the front or back of standing surface 52. This is important because a flyer who lifts her heel or raises her toes presents problems for the base cheerleaders. When the bases hold the flyer's foot, the "main base" has her hands gripped on the heel and toe of the foot and the "side base" has her hands gripped in the center of the foot, often bracing the front wrist of the main base. Balancing assembly 50, therefore, requires that the flyer keep her heel down and does not roll back on the heel while on standing surface 52.

Standing surface 52 is a substantially horizontal surface having a width "W" and length "L". In one embodiment, sanding surface is a fixed width and length of about 4 inches by 6 inches, roughly analogous to the standing area provided by the base cheerleaders. In another embodiment, standing surface 52 is an adjustable width or length (or both). Because of the small surface area provided by standing surface 52, the user must mount device 10 with a single leg in a way similar to that used when mounting a base cheerleader, thereby teaching and reinforcing proper technique and muscle memory. Support plate 54 may be about the same size as standing surface 52 and is preferably permanently attached to an upper end of support column 40.

Deflectably resilient member 56 provides at least two degrees of freedom of movement: (up and down and side-to-side) to standing surface 52. In a preferred embodiment, deflectably resilient member 56 is a pair of spaced-apart springs 56A, 56B, the upper and lower portion of each spring 56A, 56B being permanently affixed to a lower and upper surface of standing surface 52 and support plate 54 respectively. A pair of tractor springs is suitable for this purpose. Tests conducted using various sized springs revealed that smaller springs provided too much response in comparison to that typically provided by a base cheerleader and made device 10 too difficult to stand on and balance. The springs 56A, 56B along with the small area provided by standing surface 52 mimic the feeling that a flyer has after being lifted up and supported by the bases. Deflectably resilient member 56 may be some other type of compressible member such as a fluid-filled (air or water) chamber.

Figure 7:
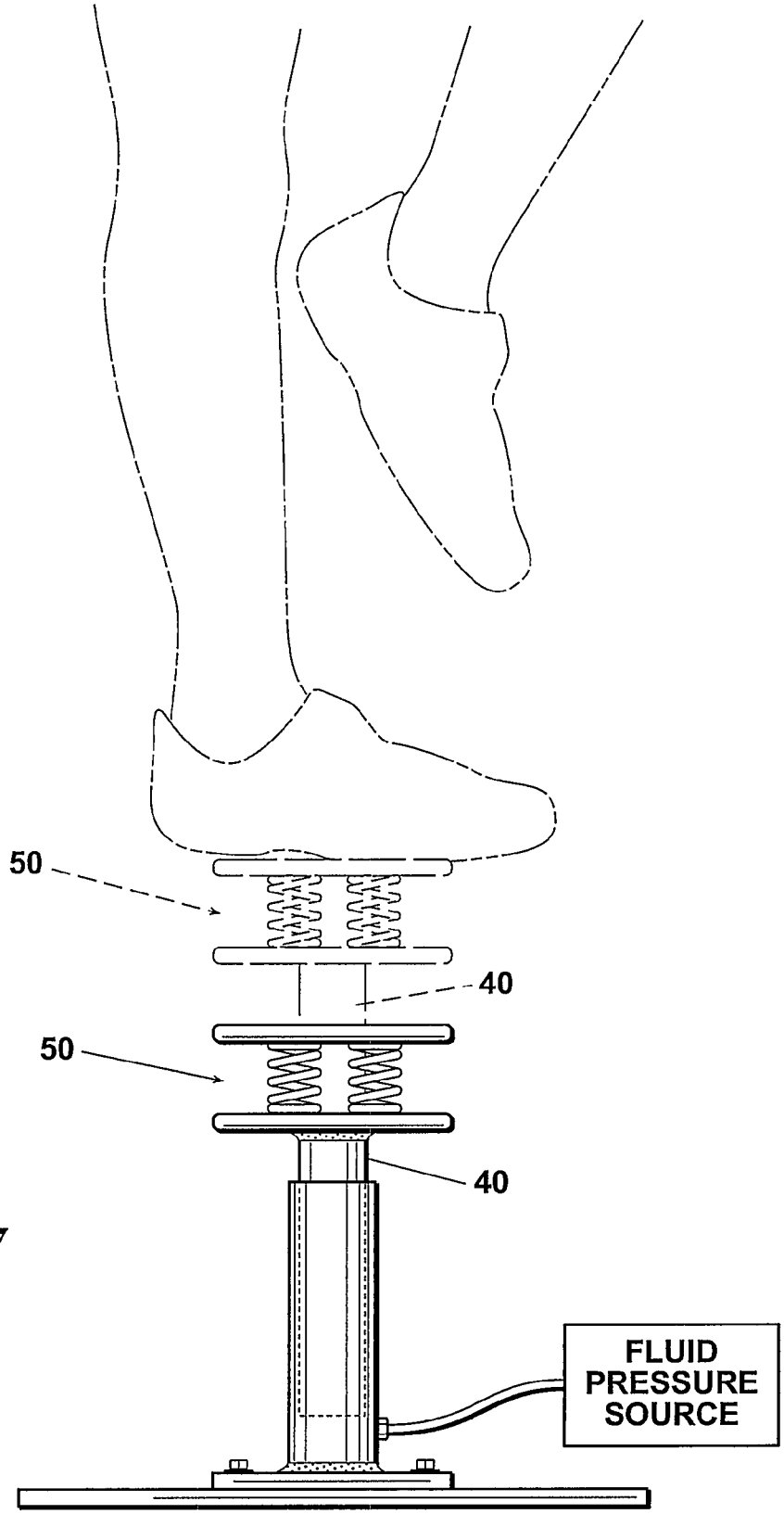
FIG. 7 is a view of an alternate embodiment of the device showing a fluid-activated column. The column moves from a first position to a second, elevated position in order to mimic the experience of a flyer when being raised by the base cheerleader.

Referring now to FIG. 7, an alternate embodiment of device 10 is illustrated. Column 40 is a fluid activated cylinder, such as pneumatic cylinder, that provides for raising balancing assembly 50 when in use. A hydraulic cylinder may also be used but is not preferred because of the possibility of spills. This feature simulates the sensation that the flyer experiences when being raised or lifted up by the bases.

Training device 10 may be used by school cheer squads at the school or taken home to use independently. It may also be used at cheerleading gyms or by anyone interested in becoming a flyer or improving or understanding his or her balance. Because training device 10 provides a standing surface 52 similar in size to that provided to the flyer by the bases, and because training device 10 mimics the feel that a flyer experiences when supported by the bases, a realistic training environment is provided. Because training device 10 ensures proper alignment of the user, the device teaches proper technique and reduces the risk of injury to the flyer and the bases. Training device 10 also allows for advanced flyer positions, such as the "Liberty," "Heel Stretch" and the "Bow and Arrow" to be practiced and mastered.

While preferred embodiments of a cheerleader training device have been described with a certain degree of particularity, many changes may be made in the details of construction and the arrangement of components without departing from the spirit and scope of this disclosure. A training device according to this disclosure, therefore, is limited only by the scope of the attached claims, including the full range of equivalency to which each element thereof is entitled.

What is claimed is:

1. A training apparatus comprising:

a stable base assembly;

a balancing assembly; and a support column located between the stable base assembly and the balancing assembly;

the balancing assembly including a delectably resilient member located between and arranged normal to a rigid support plate and a rigid longitudinally extending standing surface;

the rigid longitudinally extending standing surface being rectangular-shaped and about 5 to 7 inches in length and when in use directly contacting a forefoot and hindfoot bottom portion of a user's foot and causing the delectably resilient member to move between a stable unloaded position and an unstable loaded position;

the unstable position placing the user in an unbalanced position whenever the user lifts one of the forefoot and hindfoot bottom portion up and away from the rigid longitudinally extending standing surface.

2. A training apparatus according to claim 1, the deflectably resilient member is in the form of at least one compression spring.

3. A training apparatus according to claim 1, the deflectably resilient member is in the form of a least one compressible member.

4. A training apparatus according to claim 1, the column having a first vertical position and a second vertical position.

5. A training apparatus according to claim 1, the column moving between a first vertical position and a second vertical position.

6. A training apparatus according to claim 5, the column further comprising a hydraulic cylinder.

7. A training apparatus according to claim 5, the column further comprising a pneumatic cylinder.

8. A training apparatus according to claim 1 further comprising a width of the rigid longitudinally extending standing surface being no greater than about two-thirds of the length.

9. A training apparatus according to claim 1 further comprising at least one of the length and a width of the rigid longitudinally extending standing surface being adjustable.

10. A training apparatus comprising:

a stable base assembly;

a balancing assembly; and a support column located between the stable base assembly and ho balancing assembly;

the balancing assembly including a deflectably resilient member located between and arranged normal to a rigid support plate and a rigid longitudinally extending standing surface;

the rigid longitudinally extending standing surface being rectangular-shaped and about 3 to 5 inches in width and having a length of at least one-and-a-half times the width and when in use directly contacting a forefoot and hindfoot bottom portion of a user's foot and causing the deflectably resilient member to move between a stable unloaded position and an unstable loaded position;

the unstable loaded position placing the user in an unbalanced position whenever the user lifts one of the forefoot and hindfoot bottom portion up and away from the rigid longitudinally extending standing surface.

11. A training apparatus according to claim 10 further comprising at least one of the length and the width of rigid longitudinally extending standing surface being adjustable.

12. A method of teaching balance to a cheerleader flyer, the method comprising the steps of: providing the training apparatus according to claim 1 or 10; placing a single foot on the rigid longitudinally extending standing surface; stepping up onto the rigid longitudinally extending standing surface so that the single foot placed on the rigid longitudinally extending standing surface supports the entire weight of the user and the other foot supports no weight of the user; maintaining hindfoot and forefoot contact with the standing surface as to remain on the balancing assembly.

* * * * *